United States Patent [19]

Crago et al.

[11] 4,249,410

[45] Feb. 10, 1981

[54] DIE PRESS HAVING SELECTIVELY VARIABLE DIE ACCESS CLEARANCE

[75] Inventors: Terril M. Crago, Long Beach; Frederick C. Olsen, Huntington Beach, both of Calif.

[73] Assignee: Standun, Inc., Compton, Calif.

[21] Appl. No.: 958,006

[22] Filed: Nov. 6, 1978

[51] Int. Cl.[3] ..... B21D 22/00

[52] U.S. Cl. ..... 72/347; 29/452; 72/455; 100/214

[58] Field of Search ..... 72/347, 348, 349, 455, 72/456; 29/452; 100/214

[56] References Cited

U.S. PATENT DOCUMENTS

| | | | |
|---|---|---|---|
| 2,934,969 | 5/1960 | Neumann | 29/452 X |
| 3,130,628 | 4/1964 | Blinn | 100/170 X |
| 3,835,523 | 9/1974 | Stansfield | 29/452 X |
| 3,924,436 | 12/1975 | Misonoo | 72/347 |
| 4,080,819 | 3/1978 | Hood | 72/347 |

FOREIGN PATENT DOCUMENTS 904681 7/1972 Canada .

*Primary Examiner*—Leon Gilden

*Attorney, Agent, or Firm*—Mahoney & Schick

[57] ABSTRACT

A press has at least one reciprocal ram securing a die movable to and from an opposing die, the ram normally spacing the dies apart with a predetermined normal clearance. The die is retained in the ram assembly with at least one tensioned longitudinal bolt which bolt also normally compresses a spacer member, the bolt having longitudinal stretching means selectively actionable for longitudinally stretching the bolt without otherwise affecting bolt adjustment to relieve compression on the spacer member and permit selective transverse removal of the spacer member. When greater than normal die access clearance is required, the bolt is stretched, the spacer member removed and the ram longitudinally shortened in length for the increased clearance. Ram relengthening, spacer member replacement and an ultimate relieving of bolt stretching reassembles the ram in exact original normal form with the exact same bolt tensioning. A multiplicity of bolts and spacer members all identically operable may be used in a particular ram assembly depending on the requirements and with appropriate controls for automatic sequential operation thereof.

15 Claims, 12 Drawing Figures

DIE PRESS HAVING SELECTIVELY VARIABLE DIE ACCESS CLEARANCE

BACKGROUND OF THE INVENTION

This invention relates to a die press having selectively variable die access clearance and more particularly, to such a press having unique means incorporated therein whereby the press may be normally operated with normal minimum die access clearance, yet when required, the die access clearance may be quickly increased and then eventually quickly returned to original minimum form, all without otherwise altering the die securement when returned to its original form. The overall result is that original die adjustment is always retained when the die is in normal working position with its minimum working die access clearance, but upon the necessity arising for temporary increased die access clearance, the same can be quickly provided and upon return to normal, all original conditions will be automatically restored.

Presses of the type reciprocating dies toward and away from each other have usually included a movable ram securing and carrying a first die and a stationary press bed securing a second die. Furthermore, in modern high-speed production lines, the movable ram will reciprocate on a continuous repeating basis with material to be worked upon by the dies, such as, metal, being fed therebetween when the dies are spaced apart a maximum distance in the cycle with a predetermined die access clearance. For maximum speed of continuous press operation, the prime consideration of this predetermined die access clearance when the dies are spaced a maximum distance apart is a sufficient clearance space for the feeding of the material or part to be worked upon by the dies therebetween and into position for being worked upon by the dies, as well as removal of the finished part in some cases depending on the particular type of dies and working operation involved.

An important secondary consideration in the predetermined die access clearance is normal minor die maintenance which can be required due to normal wear and tear, and the removal of improperly formed parts from between the dies which can occur for various reasons including improper material thickness of improperly preformed parts fed between the dies for that particular metal working operation. With the press operating on a normal continuous basis, when minor maintenance cannot be performed or an improperly formed part occurs which cannot be cleared from the dies during a normal press cycling operation, the operation of the press must be immediately stopped, usually through automatic improperly formed part detection and automatic press control. The minor maintenance must then be performed and/or the improperly formed part or parts must then be removed prior to resumption of the automatic press operation.

Thus, in constructing a press of the type herein involved for operation in a high-speed production line, two basic choices for predetermined die access clearance are presented, particularly where the press is normally continuously operable with a predetermined die access clearance and when minor die maintenance is needed or improperly formed parts occur, a greater die access clearance is frequently required for the maintenance or the removal of the improperly formed parts. For maximum speed of press operation under normal production conditions with properly formed parts being produced, the predetermined die access clearance should be a minimum, just that required for automatically feeding material between the dies on a normal production basis. However, if that normal production predetermined die access clearance will not be sufficient for at least the usual minor maintenance and the usual removal of improperly formed parts from between the dies when that is required or occurs, either the predetermined die access clearance must be increased sufficient for such maintenance or improperly formed part removal which will necessarily decrease the speed of normal continuous press operation or one or both of the dies must be removed from the press for the maintenance or improperly formed part removal. In either case, the effective production output of the press will necessarily be inhibited.

An additional consideration in the construction of presses for high-speed die operation is that of die attachment to the press for maximum die accuracy. In modern production processes, it is frequently required to die form metal parts of a few thousandths of an inch thickness while maintaining a uniform accuracy of a few ten thousandths of an inch. Obviously this accuracy of formation is made more difficult with higher and higher required speed of production and, in addition to die construction accuracy, is greatly affected by the manner in which the dies are attached to the press, again the speed of operation being a factor.

It is common practice in modern press construction for such high-speed work to attach the dies by the very closely predicated use of tensioned bolts. The usual procedure is to initially attach the dies to the press with particularly located fastening bolts which are only initially slightly tensioned and then by a very closely controlled bolt tightening procedure, tensioning each of the fastening bolts in a precalculated manner for obtaining the required die alignment as well as secure retainment of the dies for maintaining such alignment during the high-speed reciprocal movement thereof. It can be understood, therefore, that the attachment and securement of the dies is a very tedious and time consuming process.

Thus, this required method of die attachment is a factor of consideration in the choices of press construction as hereinbefore discussed. If the choice of press construction is that of merely providing predetermined die access clearance under normal operation sufficient for the automatic feeding of the material to be formed between the dies, thereby requiring detachment of the dies from the press for required minor maintenance and/or for removal of improperly formed parts, this die removal and tedious re-attachment becomes a production time decreasing factor. In other words, although the use of the lesser predetermined die access clearance will greatly increase production speed, each time that minor maintenance is required or an improperly formed part occurs requiring die removal and replacement, the overall production speed benefits will be reduced.

OBJECTS AND SUMMARY OF THE INVENTION

It is, therefore, an object of this invention to provide a press of the type for reciprocating dies toward and away from each other in a part forming operation wherein the dies may have a minimum normal predetermined die access clearance for maximum production cycling press speed, yet the press has unique means associated therein for permitting quick selective increase of the die access clearance for minor maintenance or improper formed part removal and eventually a restoring of all elements to normal operating form, thereby eliminating any necessity of tedious die removal and replacement previously required with this form of die press. The press may be normally operated on a continuous basis with minimum normal predetermined die access clearance merely sufficient for the feeding of material between the dies for the ultimately die-formed part. If during such continuous operation, die maintenance is required or an improperly formed part occurs requiring greater access clearance for such maintenance or for part removal from between the dies, automatic operation of the press is ceased with the dies in their normal predetermined access clearance position, the unique means is actuated to temporarily increase the die clearance so that the maintenance can be performed or the improperly formed part can be removed, and then the unique means is again actuated to automatically restore all of the press elements to their original operating conditions including the minimum normal predetermined die access clearance and ready for resuming automatic press cycling. In this manner, press "down time" is reduced to a minimum despite the advantage of the press normally being operable at higher speeds due to its minimum normal predetermined die access clearance form.

It is a further object of the invention to provide a press of the foregoing type and having the unique and advantageous means associated therein for expeditious minor maintenance performance or improperly formed part removal, yet the additions required for providing such novel and advantageous operational features are relatively simple in nature and only require slight modification to a standard high-speed cycling press. The press in standard form will have at least one reciprocal ram mechanism carrying one of the dies and moving toward and away from another die with the minimum normal predetermined die access clearance. According to the principles of the present invention, at least one longitudinal spacer member is provided in the die mechanism normally retained under compression by at least one generally longitudinal fastening bolt which also compressively secures the die in the ram mechanism. Finally, selectively actionable fastening bolt stretching means is provided in the ram mechanism operably associated with the fastening bolts.

Thus, with the spacer member and the die normally compressively secured in the ram mechanism by the tensioned fastening bolt, and with the fastening bolt stretching means normally inactive, the ram mechanism will be normally reciprocal and the press normally operable for part forming with the desired minimum normal predetermined die access clearance. When it is necessary to temporarily increase the die access clearance for the maintenance performance or the improperly formed part removal, the stretching means is actuated to stretch the fastening bolt and relieve the compressive securement of the spacer member so that the spacer member can be quickly displaced from its assembly alignment and the ram mechanism quickly shortened in length for the temporarily increased access clearance. A restretching of the fastening bolt with reinsertion of the spacer member followed by a cessation of fastening bolt stretching will return the fastening bolt to its exact same original tensioning condition compressively securing the spacer member and die in the ram mechanism exactly as before. Thus, the ram mechanism is once again in its exact original form and reciprocal with minimum normal predetermined die access clearance.

It is still a further object of this invention to provide a press of the foregoing advantageous construction with the discussed selectively variable die access clearance which, in a preferred embodiment form, may be provided at a relatively low additional cost even though readily adaptable to semi-automatic or fully automatic sequential operation in carrying out the die access clearance increasing. In an optimum of this preferred embodiment form, a double acting, fluid actuated cylinder means is operably connected to the fastening bolt or such means is operably connected to each of the fastening bolts with the fluid cylinder means being actionable in one direction for stretching the bolt or bolts to relieve compression on the spacer member or members and permit spacer member generally transverse displacement, the fluid cylinder means being operable in the other direction for then longitudinally shortening the ram mechanism by longitudinal movement of the remaining bolt connected ram mechanism parts including the die and all without otherwise affecting the fastening bolt or bolts. Also, once the fastening bolt or bolts have been stretched relieving the compressive securement of the spacer member or members, the spacer member or members may be transversely moved from ram mechanism assembly alignment with control means such as fluid cylinder means, the same also being actionable for replacing the spacer member or members back into assembly alignment when the ram assembly has been relengthened by moving the fastening bolt or bolts in the opposite relengthening direction by their fluid cylinder means. Such use of these fluid cylinder means arrangements for the various element actuation and movements obviously adapts the overall variable die access clearance arrangement to relatively simple semi-automatic or fully automatic actuation control, while at the same time, providing the basic additions for accomplishing the selectively variable die access clearance with relatively inexpensively added additional elements.

Other objects and advantages of the invention will be apparent from the following specification and the accompanying drawings which are for the purpose of illustration only.

DESCRIPTION OF THE BEST EMBODIMENTS CONTEMPLATED

Figure 1:
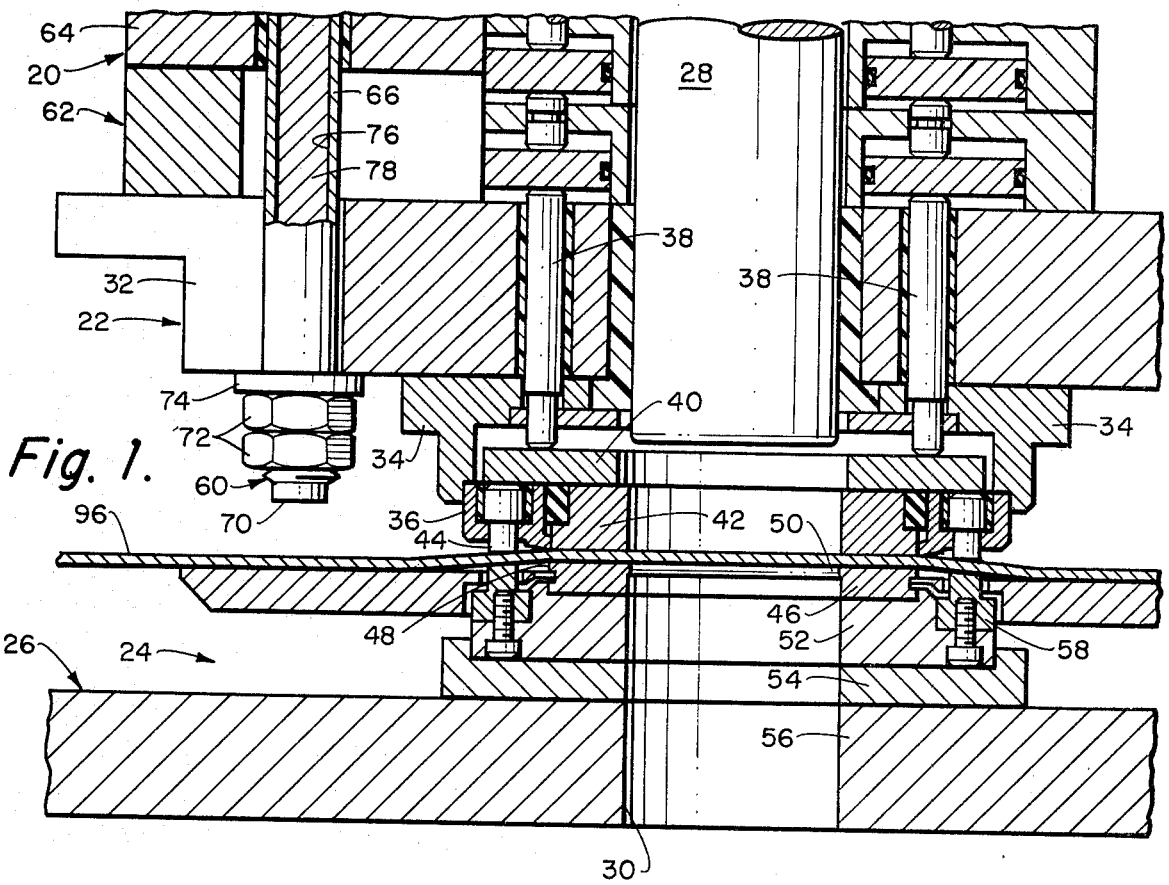
FIG. 1 is a fragmentary, vertical sectional view of an embodiment of die press incorporating the selectively variable die access clearance principles of the present invention, in this case, the press being a cup forming blank and draw press shown with a ram mechanism in an advancing position just prior to beginning the blanking operation.

Referring to FIGS. 1 through 11 of the drawings, a first preferred embodiment of the selectively variable die access clearance principles of the present invention is shown in a somewhat otherwise typical cup forming blank and draw die press as used in the metal can making industry. Generally, sheet metal is fed to the blank and draw press which press first blanks a circular blank and then immediately draws the blank into a shallow cup of necessarily precise form and thin, uniform side and bottom walls having wall thicknesses in the order of ten to thirteen thousandths of an inch with tolerances of a few ten thousandths of an inch and all depending on the particular ultimate can construction and particular metal, such as aluminum or tinplate. Although not involved here, the shallow cups thusly formed are then either redrawn and wall-ironed or merely wall-ironed to provide the deeper and smaller diameter finished can bodies of approximately four and one-half thousandths of an inch wall thickness which are ultimately filled with various beverages and the like and then sealed with an attached top or end wall.

The cup forming blank and draw press illustrated generally includes a longitudinally vertically movable ram mechanism generally indicated at 20 incorporating and securing a first or upper die assembly generally indicated at 22 and carrying the upper die assembly vertically toward and away from a second or lower die assembly generally indicated at 24 secured to a stationary press bed generally indicated at 26. A longitudinally vertically movable draw punch 28 is telescoped by the ram mechanism 20 including the upper die assembly 22 and is movable separate from the ram mechanism downwardly through the upper die assembly into a die cavity 30 of the lower die assembly 24. Both the ram mechanism 20 and the draw punch 28 are independently vertically reciprocated by usual means (not shown) such as crank arm assemblies and cam assemblies for movement in exact cycling, normally continuous operational cycling.

The blank and draw press elements thus far generally pointed out are sufficient to make up a single die press operable for blanking and drawing single shallow cups which are ultimately formed into can bodies as hereinbefore described. In actuality, the blank and draw press elements thus far pointed out merely constitute one unit of a multiple cavity blank and draw press so that, although not shown, the overall press will include a multiplicity of spaced, identical blank and draw units simultaneously operable for producing an equivalent number of shallow cups. For purposes of illustrating the principles of the present invention, however, only the single unit shown is necessary for a clear understanding as will be apparent from the following.

Still to the general blank and draw press, the upper die assembly 22 includes an upper die shoe 32 secured into the assembly of the ram mechanism 20 in a manner to be hereinafter described and, in turn, securing a spacer ring 34 downwardly supporting a blanking die ring 36. A multiplicity of separately vertically movable pressure pins 38 extend downwardly through the upper die shoe 32 and have upper ends downwardly pressure urged by a fluid pressure assembly 40 in the ram mechanism 20 above the upper die shoe with lower ends projecting downwardly through the spacer ring 34 downwardly abutting a pressure ring 40. The pressure ring 40, in turn, partially inwardly overlies a vertically movable draw pad ring 42 which is generally telescoped by the blanking die ring 36. The pressure ring 40 outwardly overlies a multiplicity of contact pins 44 which extend vertically movably down through the blanking die ring 36.

The lower die assembly 24 includes a central combined blank and draw die ring 46 having a radially outwardly facing blanking edge 48 and a radially inwardly facing drawing surface 50, the latter forming a part of the die cavity 30 and the ring downwardly abutting a support ring 52. The support ring 52, in turn, downwardly abuts and is partially radially enclosed by a positioning ring 54 which is supported on a lower die shoe 56 of the press bed 26, the support ring 52, positioning ring 54 and lower die shoe 56 radially inwardly completing the die cavity 30. Spaced radially outwardly of the blank and draw ring 46, the support ring 52 has stationary contact pins 58 secured inset therein which vertically opposes the previously described contact pins 34 of the upper die assembly 22.

Figure 5:
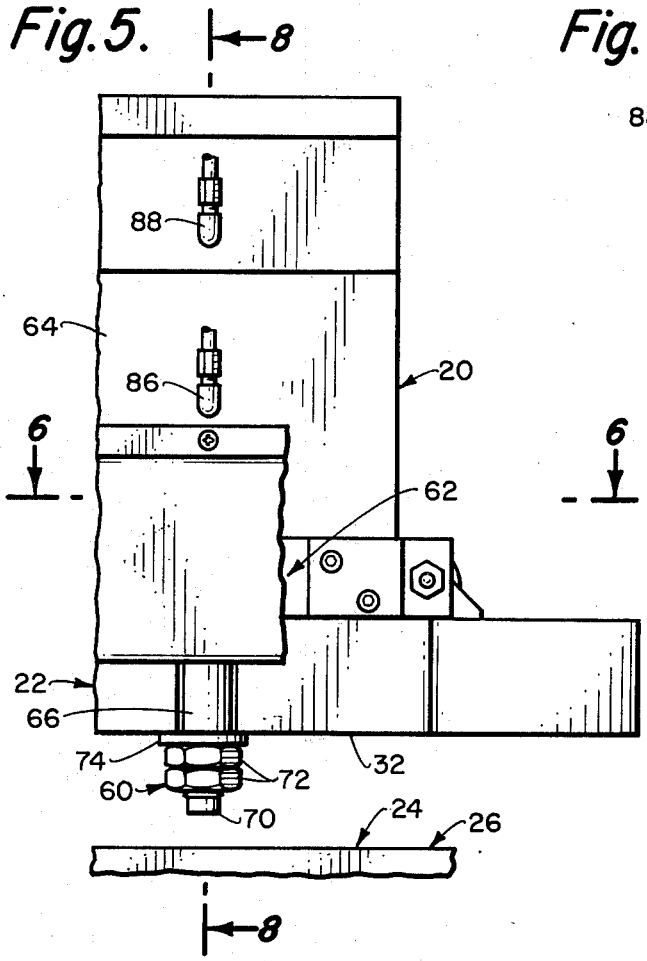
FIG. 5 is a reduced, fragmentary, front elevational view of the blank and draw press of FIG. 1 shown in normal operating fully withdrawn position with normal predetermined die access clearance.
Figure 8:
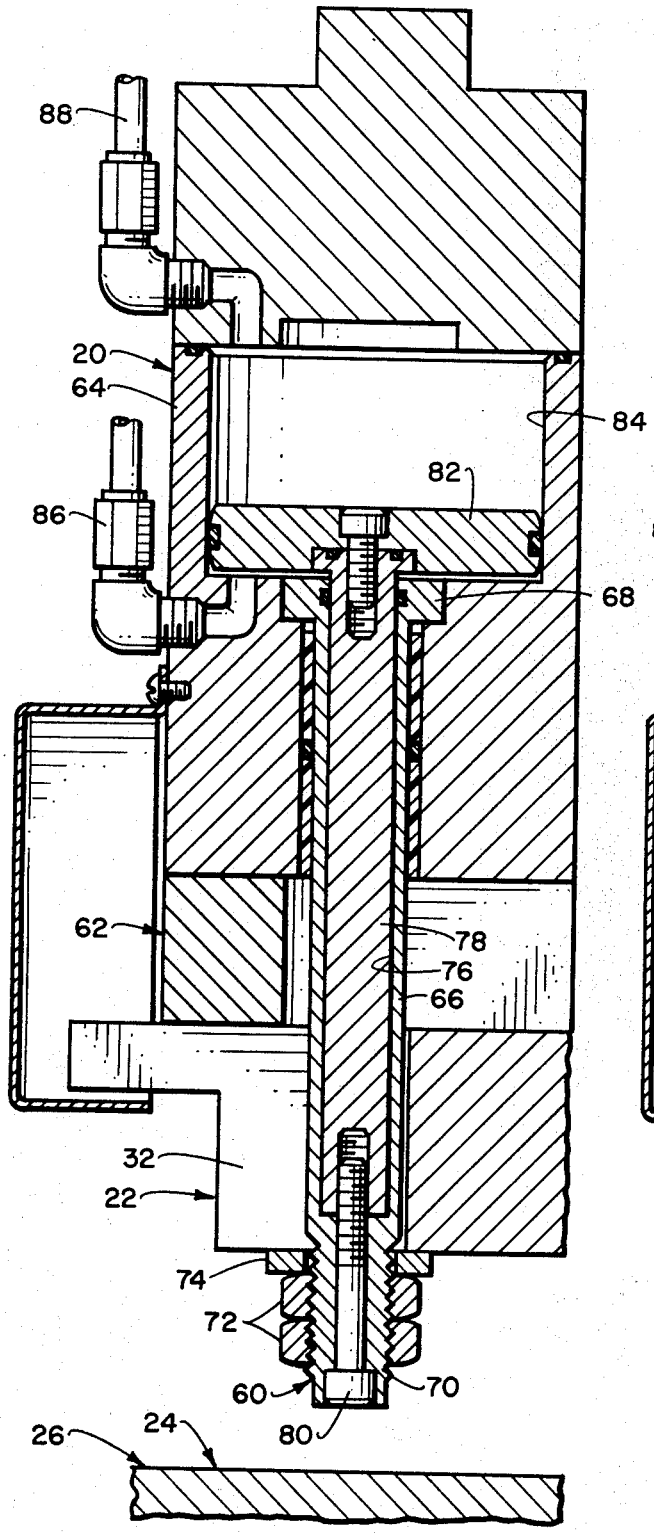
FIG. 8 is an enlarged, fragmentary, verticle sectional view looking in the direction of the arrows 8—8 in FIG. 5 and similar to FIG. 5 showing the ram mechanism in normal operating fully withdrawn position with normal predetermined die access clearance, the spacer member being in normal ram mechanism assembly.

More particularly to the structure providing the unique advantages of the present invention, the upper die shoe 32 and, therefore, basically the upper die assembly 22, is outwardly secured into the ram mechanism 20 by a multiplicity of generally vertical fastening bolts generally indicated at 60, one being shown in the drawings. Referring for the moment to FIGS. 5 and 8, a transverse row of transversely spaced fastening bolts 60 is positioned along the front of the ram mechanism 20, the fastening bolts normally vertically compressing a forwardly transversely removable spacer member or bar generally indicated at 62 vertically between the front portion of the upper die shoe 32 and an intermediate part 64 of the ram mechanism as shown. In the particular embodiment of blank and draw press illustrated, there is the forward row of fastening bolts 60 and forward spacer bar 62 as described and an identical rearward row of fastening bolts with spacer bar along the rear portion of the ram mechanism 20 so that there is a multiplicity of both fastening bolts and spacer members or bars with the spacer bars transversely opposed and transversely oppositely selectively removable from the ram mechanism assembly as will be hereinafter described more in detail. Furthermore, each of the fastening bolts 60 is substantially identically constructed and operable, and each of the spacer bars 62 is substantially reversely identical and operable as will also be hereinafter described more in detail. Still further, this arrangement is practical whether the blank and draw press is of single cavity or multiple cavity.

Still referring to FIGS. 5 and 8, in a unique optimum form, each of the fastening bolts 60 is of modified "stress-bolt" construction. That is to say, various usual forms of stress-bolts are well known as used for fastening different structural elements under tensioned fastening bolt conditions, for instance, fastening rolls of rolling mills in the steel industry, fastening wheels or marine propellers to hubs, and various steam turbine applications. In all cases, these regular or standard stress-bolts are arranged to fasten elements in normal bolt fashion, but also include means, usually internally thereof, which may be activated to temporarily lengthen the bolt during the fastening operation so that during such lengthening or stretching of the bolt, the nuts or other take-up means of the bolt may be easily operated and when the temporary stretching of the bolt is relieved, the bolt will grip its fastened elements with a predetermined force caused by the resultant tensioning of the bolt. With the fastening bolts 60 of the present invention, use of this tensioning concept has been made, but uniquely added thereto is further structure to provide further unique bolt action not heretofore possible with the standard stress-bolts.

As shown in FIG. 8, each of the fastening bolts 60 includes a cylindrical outer shaft 66 having an integral upper enlarged head 68 and a lower threaded end 70 threadably receiving nuts 72 against a flat washer 74. Thus far, therefore, these fastening bolts 60 are of usual bolt form. However, each of the fastening bolts 60 has an upwardly opening cylindrical recess 76 formed therein extending axially downwardly to spaced from the threaded end 70 receiving a complementary formed cylindrical stretching shaft therein which is secured in the recess against axial displacement by a screw 80. The extreme upper end of this stretching shaft 78 which projects axially upwardly spaced above the outer shaft head 68 is secured to a radially enlarged piston 82 also spaced upwardly of the outer shaft head 68 and vertically movably received in a cylinder 84 formed in the ram mechanism intermediate part 64. Finally, the piston 82 may be urged upwardly in the cylinder 84 by compressed fluid, such as air, from a lower fluid line 86 opening into the cylinder 84 beneath the piston, and the piston may be urged downwardly by compressed fluid from an upper fluid line 88 opening into the cylinder at the upper end thereof above the piston.

Thus, fluid admitted to the cylinder 84 through the lower fluid line 86 will urged the piston 82 upwardly including the stretching shaft 78 and its fastened outer shaft 66 so as to urge the upper die assembly 22 upwardly. Fluid through the upper fluid line 88 will urge the piston 82 downwardly also including the stretching shaft 78 and, primarily through the lower end abutment of the stretching shaft within the outer shaft 66, this outer shaft. The purposes and resultant consequences of these unique operational capabilities of the fastening bolts 60 in the ram mechanism 20 will be hereinafter described in proper perspective and sequence.

Figure 6:
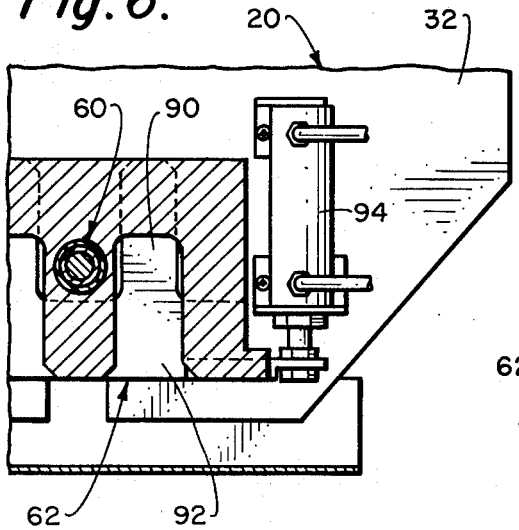
FIG. 6 is an enlarged, fragmentary, horizontal sectional view looking in the direction of the arrows 6—6 in FIG. 5 and showing the ram mechanism with a spacer member assembled in normal ram mechanism operating position.
Figure 9:
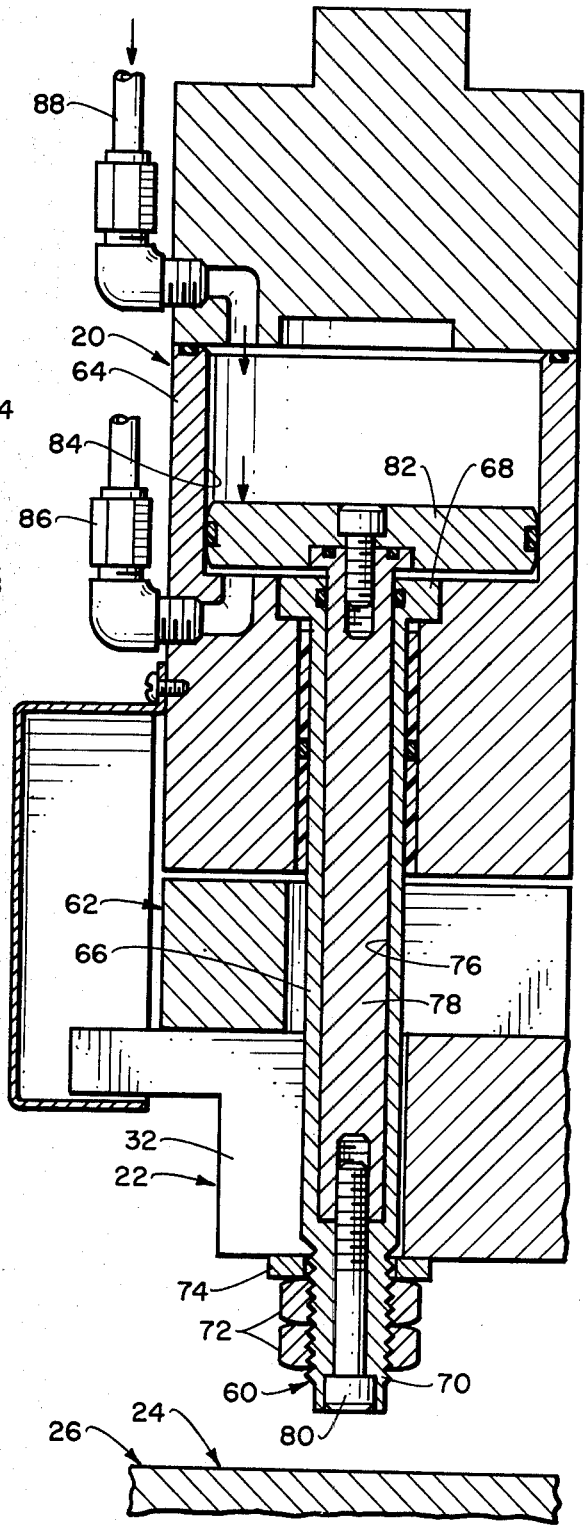
FIGS. 9, 10 and 11 are views similar to FIG. 8 showing the selectively sequential displacement of the spacer member from its normal assembly in the ram mechanism and the ram mechanism longitudinally shortened temporarily providing the increased die access clearance for removal of an improperly formed cup according to the principles of the present invention.

Now referring to FIGS. 5, 6 and 8, each of the two spacer bars 62, the forward spacer bar being shown, is formed with spaced projecting finger portions 90 along the length thereof as seen generally in plan view in FIG. 6. In the compressive assembly of the ram mechanism 20, these finger portions 90 partially underlie the ram mechanism intermediate part 64 as does a spacer bar solid portion 92 transversely between the finger portions 90, the ram mechanism intermediate part being similarly, but oppositely formed for the interfitting relationship shown. As a consequence, therefore, when the spacer bars 62 are fully in the assembly of the ram mechanism 20, they provide full support between the upper die assembly 22 and the ram mechanism intermediate part 64 for proper compressive assembly of the ram mechanism 20. At the same time, if and when slight vertical clearance is provided between the upper die assembly 22 and the ram mechanism intermediate part 64 as shown in FIG. 9 and the spacer bars 62 are displaced or moved only a minimum transverse distance to the displaced position shown in FIGS. 7 and 10, the spacer bars will be vertically clear of the ram mechanism intermediate part due to their unique interfitting relationship. The spacer bars 62 are preferably moved transversely between assembled and displaced positions by double acting fluid cylinders 94 attached to opposite ends thereof. The purpose and sequential operation of this spacer bar arrangement will be fully apparent from the following description of the overall operation of the blank and draw press of the present invention immediately following.

Figure 2:
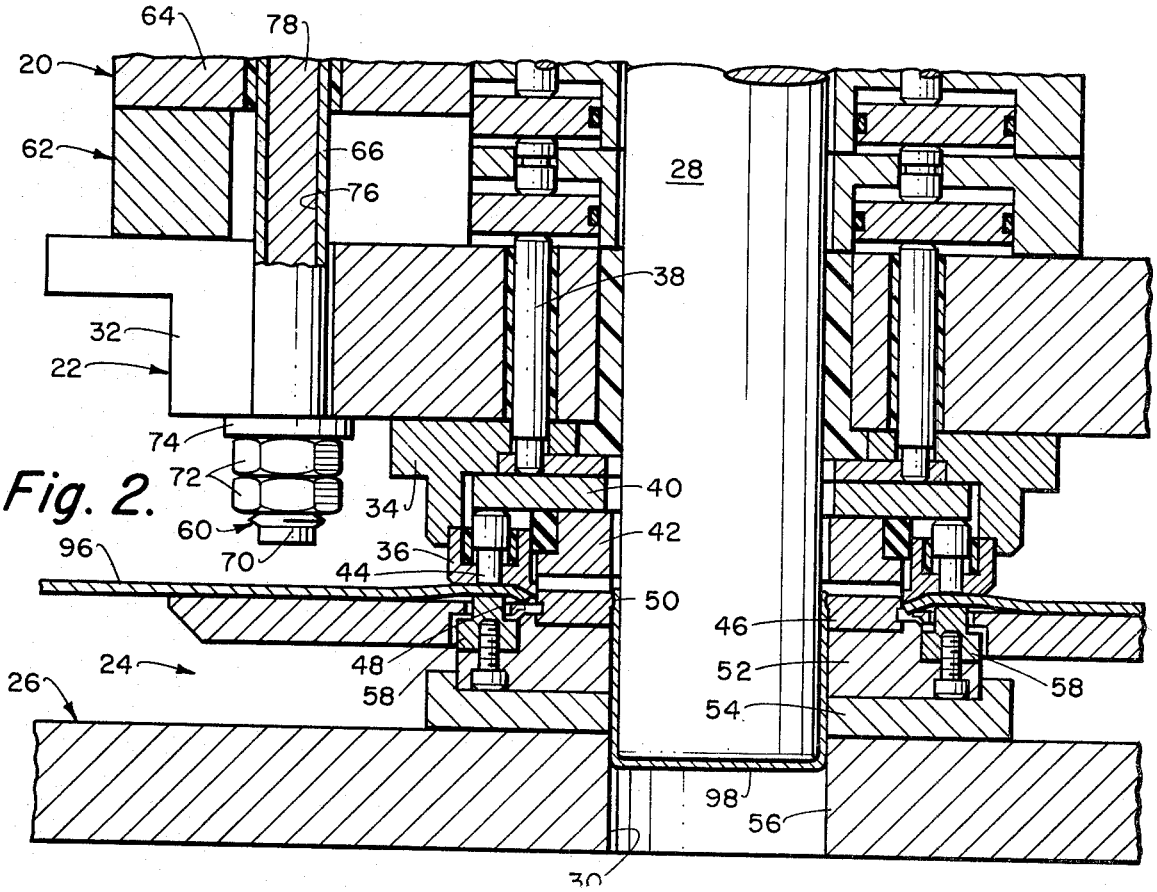
FIG. 2 is a view similar to FIG. 1, but with the blanking die having advanced for performing the blanking operation and a draw punch having advanced and being intermediate the proper formation of a cup.
Figure 3:
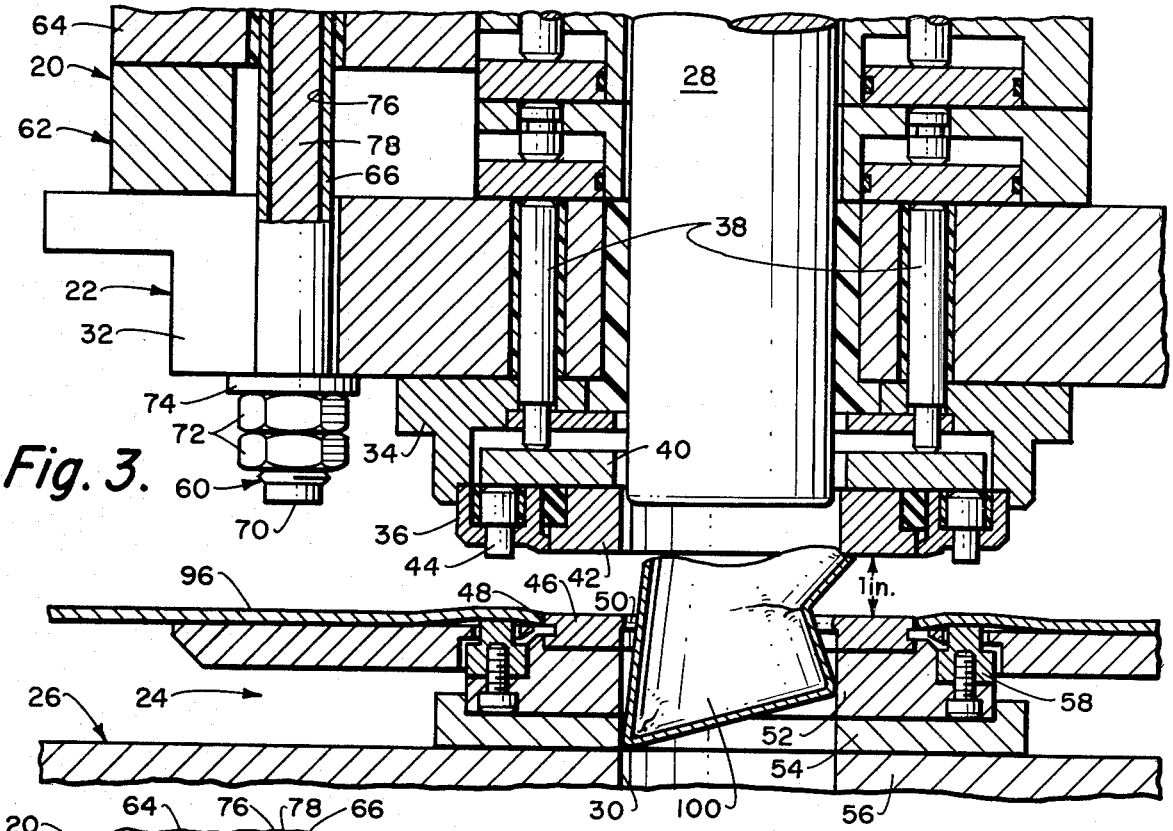
FIG. 3 is a view similar to FIG. 1, but with the ram mechanism withdrawn fully to normal predetermined die access clearance and with an improperly formed cup shown between the dies requiring further die separation for removal.

In normal use of the blank and draw press of the present invention, the ram mechanism 20 with its upper die assembly 22, its spacer bars 62 and its draw punch 28 is assembled as shown in FIGS. 1 through 3, 5, 6 and 8, the press bed 26 with its lower die assembly 24 being assembled as shown in FIGS. 1 through 3. In such assemblies, the upper and lower die assemblies 22 and 24 are secured in the usual manner by tensioned fastening bolts so that all of the elements of each will be properly vertically aligned and operable, all generally in the usual normal manner well known to those skilled in the art. Particularly, for purposes of the present invention, the assembly of the ram mechanism 20 will include the spacer bars 62 vertically compressed between the upper die assembly 22 and the ram mechanism intermediate part 64 by the now normally tensioned fastening bolts 60 which are tension engaged by their outer shaft heads 68 downwardly with the ram mechanism intermediate part 64 and upwardly by the nuts 72 and washers 74 with the upper die shoe 32. This original working tensioning of the fastening bolts 60 may be obtained in usual manner merely by the selective tightening of the nuts 72, or can include the selective use of the fastening bolt stretching shafts 78 with the usual bolt stretching downward pressure of pressurized fluid from the upper fluid line 88 into the cylinder 84 against the piston 82 in usual stress-bolt fashion in order to ultimately obtain the desired normal tensioning of the fastening bolts 60. The important point is that at the start of normal cycling of the blank and draw press, the fastening bolts 60 will be in normal tension normally compressing the spacer bar 62 and the stretching shafts 78, pistons 82 and cylinders 84 will be dormant or normally inactive.

Starting the normal cycling of the blank and draw press with the ram mechanism 20 in normal maximum upwardly withdrawn position producing normal working predetermined die access clearance, this ram mechanism positioning and die access clearance between the upper and lower die assemblies 22 and 24 is shown in FIGS. 5 and 8, as well as in FIG. 3 (ignoring in FIG. 3 the condition of the metal sheet or strip material being worked). As shown in FIG. 1, sheet or strip material 96, for instance, aluminum or tinplate, is fed transversely across the lower die assembly 24 and the ram mechanism 20 starts its downward movement carrying the upper die assembly 22 downwardly toward the lower die assembly 24. In FIG. 1, the draw pad ring 42 of the upper die assembly 22 is just exerting downward pressure against the material 96 forcing it downwardly against the blank and die draw ring 46 of the lower die assembly 24, the draw pad ring being urged downwardly by a predetermined fluid pressure transmitted thereto by the pressure pins 38 and the pressure ring 40. The spacer ring 34 has, in turn, carried the blanking die ring 36 of the upper die assembly 22 downwardly just ready to engage the material 96 with the contact pins 44 just engaging.

Referring to FIG. 2, the ram mechanism 20 has progressed downwardly in its cycle carrying the blanking die ring 36 through the material 96 while the contact pins 44 of the upper die assembly 22 force the material downwardly against the contact pins 58 of the lower die assembly 24 radially outwardly to thereby blank a circular blank which, at instant of blanking, is downward pressure retained by the predetermined fluid pressure forcing or retaining the draw pad ring 42 downwardly, the circular blank not being shown. Immediately following the formation of the circular blank, the draw punch 28 which has also begin its downward cycling movement, passes downwardly through the draw pad ring 42 of the upper die assembly 22 engaging the material 96 and beginning to draw the material over the drawing surface 50 of the blank and draw die ring 46 forcing it downwardly into the die cavity 30. As specifically shown in FIG. 2, the material 96 has been nearly fully formed into a shallow drawn cup 98 which will later be fully formed into a can body. As the draw punch 28 passes on downwardly from a position shown in FIG. 2 through the die cavity 30 carrying the shallow drawn cup 98 therethrough and the draw punch begins its reverse upward movement, the shallow drawn cup is stripped therefrom by usual stripper means (not shown) and the draw punch ultimately returns upwardly to the position shown in FIG. 3 while the ram mechanism 20 ultimately carries the upper die assembly 22 to its normal working predetermined die access clearance position also shown in FIG. 3. With the repositioning of the sheet or strip material 96, the ram mechanism 20 immediately begins its next downward movement cycle.

It will be seen that with the blank and draw press thusly normally operable, the normal working predetermined die access clearance is sufficient for working operation continuous cycling since only a minimum access clearance is required. The only clearance that is required is that sufficient for the ram mechanism 20 to fully withdraw the upper die assembly 22 from the lower die assembly 24 and permit repositioning of the sheet or strip material 96 for the next cycling blank and draw operation. There is only this flat material repositioning of the material 96 to consider since the ultimately formed shallow drawn cup 98 is ultimately stripped from the draw punch 28 after formation beneath the lower end of the die cavity 30.

However, although this minimum normal working predetermined die clearance is sufficient for normal cycling of the blank and draw press when normal shallow cups 98 are being successfully formed, there are occasions when, for instance, improper sheet or strip material 96 or other malfunctioning causes an improper cut 100 (FIG. 3) to be formed resulting in the blank and draw press being immediately stopped through its appropriate automatic controls. As shown in FIG. 3, in many instances of improper cut 100 formation, the same cannot be downwardly removed through the die cavity 30. At the same time, due to the size of the improper cup 100, the minimum normal working predetermined die access clearance between the upper and lower die assemblies 22 and 24 will not permit upward movement and removal of the improper cut therebetween. Thus, without the unique added construction provided according to the principles of the present invention, the upper die assembly 22 and in many cases both upper and lower die assemblies 22 and 24 would have to be removed, the improper cut 100 removed and the die assemblies remounted and aligned on the blank and draw press through the tedious precise tensioning of the fastening bolts including the fastening bolts 60 of the ram mechanism 20.

According to the principles of the present invention, however, starting from the position of the ram mechanism 20 shown in FIG. 3, that is, in its normal fully upwardly withdrawn position providing the minimum normal working predetermined die access clearance, which is also the position shown in FIG. 8, pressurized fluid is admitted through the upper fluid line 88 into the cyclinder 84 of the ram mechanism 20 downwardly against the piston 82 for each fastening bolt 60. This acts downwardly on each fastening bolt stretching shaft 78 which bears downwardly on each fastening bolt outer shaft 66 causing the same to be axially or lengthwise elongated or stretched which, in turn, relieves upward compression on the upper die shoe 32 without any alteration or change of the particular fastening bolt nuts 72. Stretching of each of the fastening bolts 60, therefore, relieves vertical assembly compression on the spacer bars 62 creating a slight vertical clearance for the spacer bars in the ram mechanism 20 assembly as shown in FIG. 9 so that the spacer bars are now free for transverse movement or displacement from the ram mechanism assembly.

Figure 7:
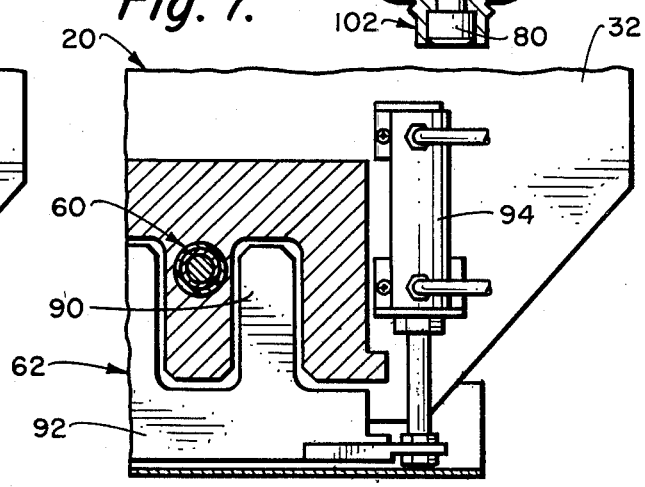
FIG. 7 is a view similar to FIG. 6, but looking in the direction of the arrows 7—7 in FIG. 10 and showing the spacer member of FIG. 6 selectively displaced from the normal ram mechanism assembly.
Figure 10:
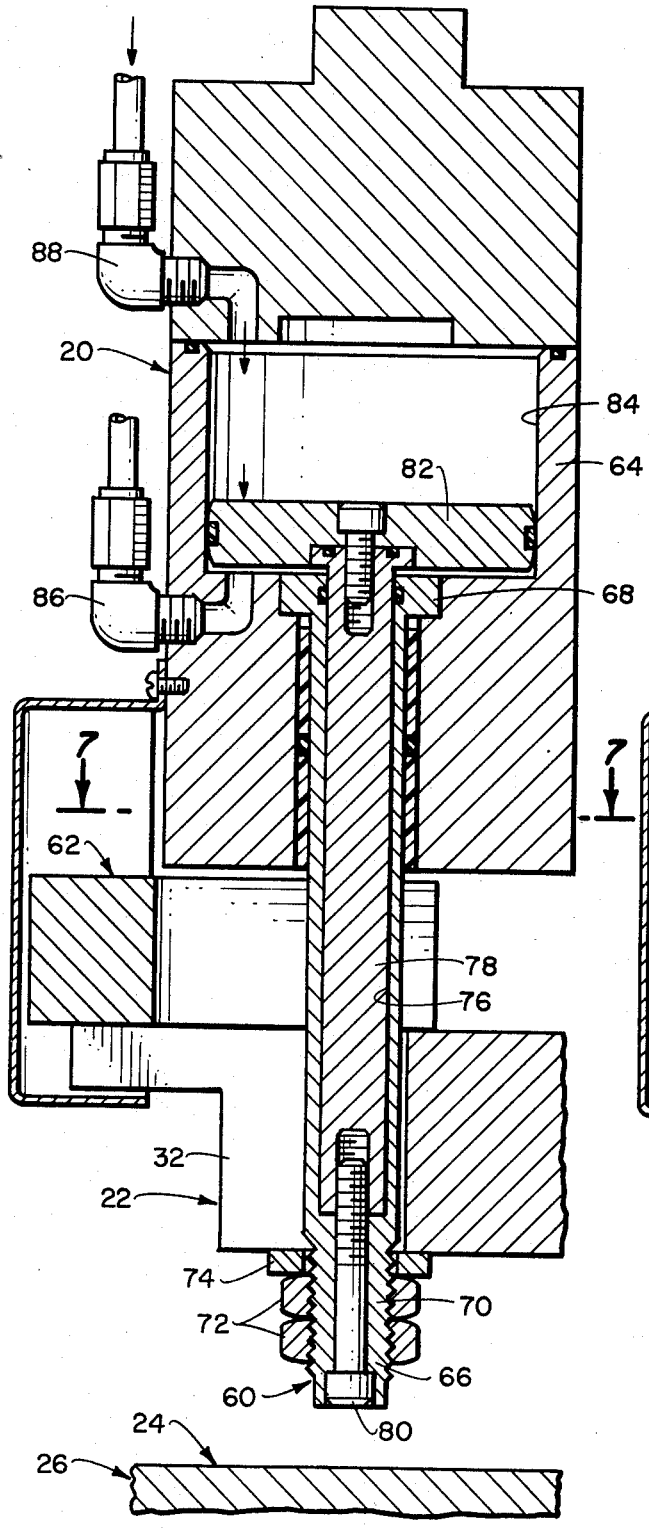

Referring to FIG. 6, pressurized fluid is then admitted to the fluid cylinders 94 of each of the spacer bars 62 moving or displacing the spacer bars transversely from the position shown in FIG. 6 to the position shown in FIGS. 7 and 10. The direction of pressurized fluid through the upper fluid lines 88 of the cylinders 84 for each of the fastening bolts 60 can then be relieved with pressurized fluid now being directed through the lower fluid lines 86 into the cylinders 84. This not only relieves the stretching of the fastening bolts 60, but also moves the fastening bolts axially upwardly in the cylinders 84 by the pressurized fluid beneath the pistons 82 from the positions in FIG. 10 to the upper positions shown in FIG. 11, that is, until the upper die shoe 32 upwardly vertically abuts the ram mechanism intermediate part 64 while the spacer bars 62 move upwardly so as to be transversely beside the ram mechanism intermediate part.

Figure 4:
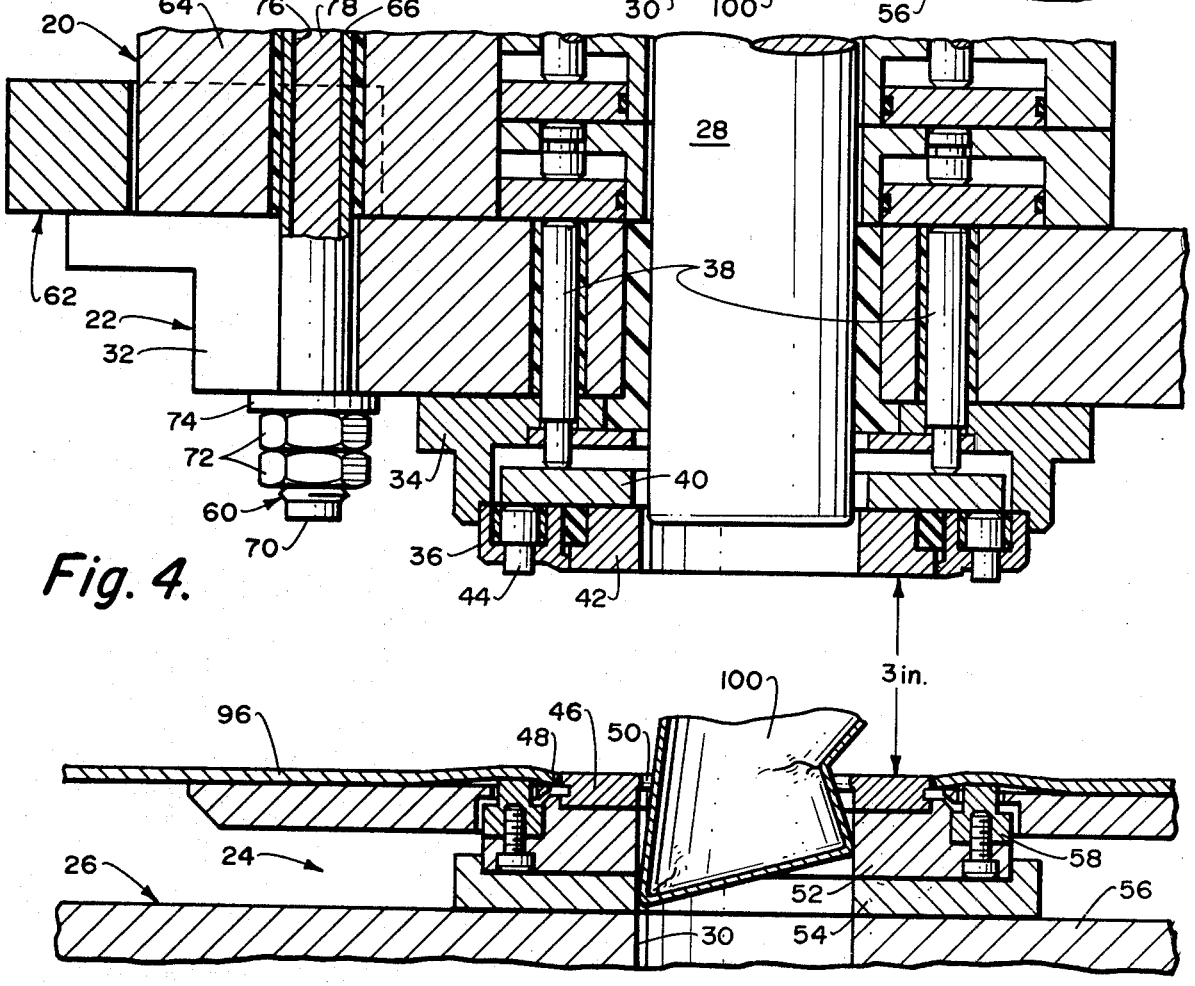
FIG. 4 is a view similar to FIG. 3, but showing operation of certain parts of the ram mechanism according to the present invention increasing the die access clearance from the normal predetermined die access clearance of FIG. 3 to provide sufficient clearance for removal of the improperly formed cup.

Thus, the ram mechanism 20, in effect, is vertically shortened, this shortened position also being shown in FIG. 4. As can be seen in FIG. 4, the normal working predetermined die access clearance vertically between the upper and lower die assemblies 22 and 24 has been temporarily increased by the vertical dimensions of the spacer bars 62. As an example, in the embodiment of blank and draw press shown and described herein, the normal working predetermined die access clearance is about one inch and transverse displacement of the spacer bars 62 with the vertical shortening of the ram mechanism 20 has temporarily increased the clearance to three inches which is obviously sufficient vertical space for the removal of the improper cup 100 upwardly and transversely outwardly between the upper and lower die assemblies 22 and 24 as is evident from FIG. 4.

Figure 11:
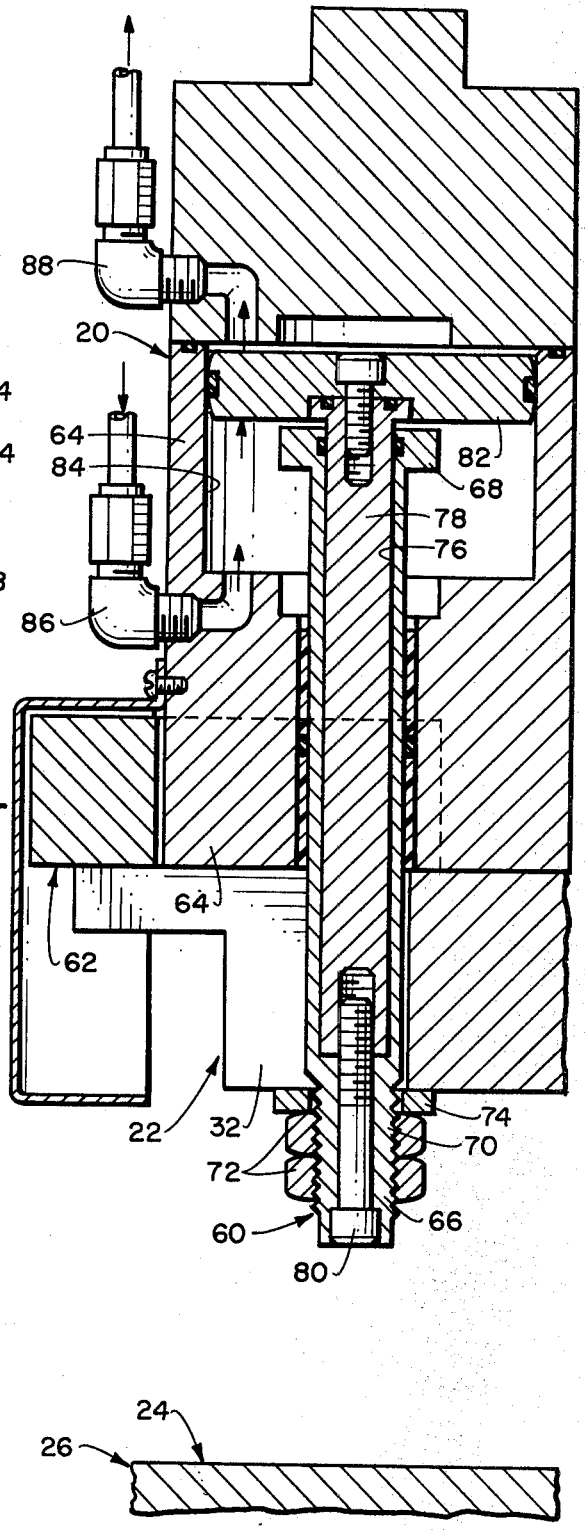

Once the improper cup 100 has been removed, pressurized fluid is relieved from the lower fluid lines 86 and readmitted to the upper fluid lines 88 for the ram mechanism cylinders 84 causing a relengthening of the ram mechanism 20 from the position shown in FIGS. 4 and 11 back to the position shown in FIG. 10 with continued pressure restretching the fastening bolts 60. This creates the space and clearance for the spacer bars 62 and the spacer bars are transversely replaced into the vertical assembly of the ram mechanism 20 by the fluid cylinders 94 from the positions shown in FIGS. 7 and 10 to the positions shown in FIGS. 6 and 9. Finally, all pressurized fluid to the ram mechanism cylinders 84 is relieved permitting the fastening bolt outer shafts 66 to return to their normal tensioned axial lengths once again vertically compressing all of the upper die shoe 32, the spacer bars 62 and the ram mechanism intermediate part 64 in the normal working assembly of the ram mechanism 20. Thus, the normal working assembly of the ram mechanism 20 has been restored and normal working predetermined die clearance vertically between the upper and lower die assemblies 22 and 24 has been restored for the high-speed operation of the blank and draw press.

According to the present invention, therefore, the ram mechanism 20 is normally operable in normal working cycles with a normal working predetermined die access clearance of minimum form permitting high-speed blank and draw press operation. However, upon an improper cup 100 being formed or minor maintenance operations being necessitated requiring greater die clearance, the ram mechanism 20 may be uniquely and conveniently temporarily shortened to provide increased die access clearance and sufficient space for convenient removal of the improper cup 100 from between the upper and lower die assemblies 22 and 24, or for the maintenance performance. Thereafter, the ram mechanism 20 may be quickly relengthened into exact original form including into a form wherein the die fastening bolts 60 are in their exact original adjusted form properly tensioned for exact upper and lower die assembly alignment. As a result, improperly formed cups such as the improper cup 100 may be quickly removed or minor die maintenance performed without the tedious removal of the various die assembles 22 and 24 and when the various press elements are returned to their working positions and assembly, the original alignments will always be returned.

Figure 12:
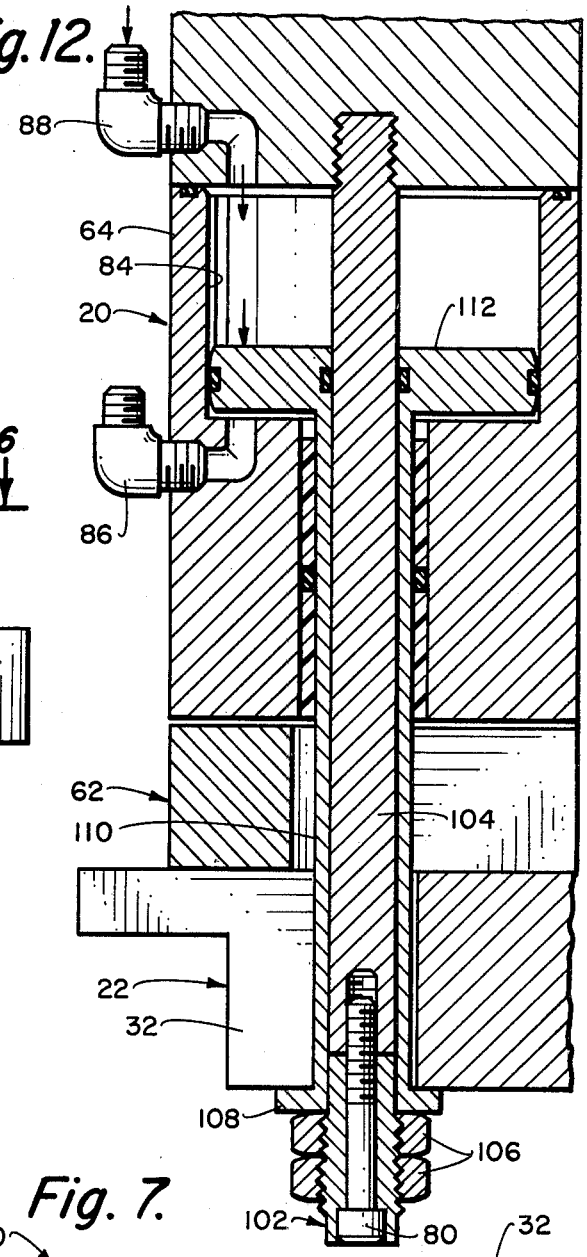
FIG. 12 is a fragmentary, vertical sectional view similar to FIG. 9, but illustrating a second embodiment of cup forming blank and draw press incorporating the principles of the present invention.

A second embodiment form of the fastening bolts for the ram mechanism 20 is shown in FIG. 12, the fastening bolts 102 again being of modified stress-bolt form. However, main shaft 104 of each of the fastening bolts 102 is upwardly threadably secured through the cylinder 84 into the ram mechanism intermediate part 64 and the lower end of this main shaft threadably receives nuts 106 upwardly compressing a flanged lower end 108 of a telescoping stretching shaft 110 against the upper die shoe 32. The stretching shaft 110 extends upwardly through the upper die shoe 32, normally through the spacer bars 62 and through a portion of the ram mechanism intermediate part 64 into the cylinder 84 where it is formed integral with a piston 112.

Thus, with each of the second embodiment fastening bolts 102, the main shaft 104 may be normally tensioned to normally vertically compress the various elements of the ram mechanism 20 in proper assembly just as before and providing the minimum normal working predetermined die access clearance for high-speed blank and draw press operation. When it is necessary to gain the increased die access clearance for the removal of an improper cup 100 from between the upper and lower die assemblies 22 and 24 for maintenance operations, downward pressure on the piston 112 through the flange lower end 108 of the stretching shaft 110 will temporarily sufficiently stretch and axially elongate the main shaft 104 providing the clearance for the spacer bars 62 to be transversely displaced and the ram mechanism 20 shortened substantially the same as before. Relengthening of the ram mechanism 20, as before, is just the opposite procedure with the ultimate reassembly into original working form again being without ultimately affecting the fastening bolt tensioning in the working assembly. Therefore, again, the increased die assembly access clearance may be quickly temporarily provided for removal of an improperly formed cup or maintenance operations without the necessity of the tedious and time consuming die assembly removal as was heretofore necessary with the prior constructions.

As previously alluded to, although the unique selectively variable die access clearance principles of the present invention have been specifically described herein embodied in a particular blank and draw press, with an understanding thereof from the foregoing, it is apparent that these same selectively variable die access clearance principles may be readily applied to virtually any form of die press. For this reason, it should be kept in mind that the applying of such principles as particularly described and shown herein is merely by way of example and that it is not intended thereby to limit the scope of the present invention beyond that set forth in the appended claims and the patent equivalents properly accorded thereto.

We claim:

1. In a press of the type having at least one longitudinally reciprocal ram mechanism including a first die assembly therein movable by movement of said ram mechanism longitudinally toward and away from a press second die assembly in a normal working operation, said first die assembly of said ram mechanism in a normal fully withdrawn position away from said press second die assembly having a predetermined normal longitudinal clearance from said second die assembly; the improvements comprising: at least one generally longitudinal fastening bolt normally under longitudinal tension compressively securing said first die assembly in said ram mechanism movable therewith, said fastening bolt being constructed and arranged having longitudinal stretching means operably associated therewith normally inactive and selectively actionable without otherwise effecting adjustment of said fastening bolt for temporarily longitudinally stretching said fastening bolt to relieve longitudinal compression of certain parts of said ram mechanism normally retained in compression by said fastening bolt; a selectively removable longitudinal spacer member in said ram mechanism normally subject to said fastening bolt longitudinal tension and normally retained thereby under compression, said spacer member being constructed and arranged assembled in said ram mechanism for selective displacement from assembly in said ram mechanism upon said fastening bolt being temporarily stretched by said stretching means relieving said compression and permitting said ram mechanism to be longitudinally shortened increasing said first die assembly normal clearance from said second die assembly, replacement of said spacer member into said assembly in said ram mechanism with return of said fastening bolt stretching means to normally inactive restoring said ram mechanism to exact normal form including said fastening means compression and said first die assembly normal clearance with said second die assembly; moving means associated with said ram mechanism for longitudinally shortening and lengthening said ram mechanism during said displacement of said spacer member from said assembly in said ram mechanism.

2. In a press as defined in claim 1 in which said spacer member is selectively displaceable from and replaceable into said assembly in said ram mechanism generally transversely.

3. In a press as defined in claim 1 in which selectively actionable control means is operably connected to said spacer member for reciprocally moving said spacer member in said selective displacement from and replacement into said assembly in said ram mechanism.

4. In a press as defined in claim 1 in which said generally longitudinal fastening bolt is one of a multiplicity of similar fastening bolts similarly positioned in said ram mechanism and each having said longitudinal stretching means operably associated therewith; and in which said selectively removable longitudinal spacer member is one of a multiplicity of selectively removable longitudinal spacer members in said ram mechanism each normally subject to said longitudinal tension of certain of said fastening bolts normally retained thereby under said compression, each of said spacer members being similarly selectively displaceable from and replaceable into said assembly in said ram mechanism.

5. In a press as defined in claim 1 in which said generally longitudinal fastening bolt is one of a multiplicity of similar fastening bolts similarly positioned in said ram mechanism and each having said longitudinal stretching means operably associated therewith; in which said selectively removable longitudinal spacer member is one of a multiplicity of selectively removable longitudinal spacer members in said ram mechanism each normally subject to said longitudinal tension of certain of said fastening bolts normally retained thereby under said compression, each of said spacer members being similarly selectively displaceable from and replaceable into said assembly in said ram mechanism; and in which each of said spacer members is similarly generally transversely reciprocally displaceable from and replaceable into said assembly in said ram mechanism by selectively actionable control means.

6. In a press as defined in claim 1 in which said moving means associated with said ram mechanism is operably connected to said fastening bolt for longitudinal movement of parts of said ram mechanism through longitudinal movement of said fastening bolt to longitudinally shorten and lengthen said ram mechanism.

7. In a press as defined in claim 1 in which said moving means associated with said ram mechanism includes fluid cylinder means operably connected to said fastening bolt for longitudinally moving parts of said ram mechanism by longitudinal movement of said fastening bolt to longitudinally shorten and lengthen said ram mechanism.

8. In a press as defined in claim 1 in which each of said fastening bolt stretching means and said moving means associated with said ram mechanism include portions of a selectively actionable double acting fluid cylinder means operably connected to said fastening bolt actionable for both stretching said fastening bolt and through said fastening bolt longitudinally moving parts of said ram mechanism to shorten and lengthen said ram mechanism.

9. In a press as defined in claim 1 in which said spacer member is selectively displaceable from and replaceable into said assembly in said ram mechanism generally transversely; and in which said moving means associated with said ram mechanism is operably connected to said fastening bolt for longitudinal movement of parts of said ram mechanism through longitudinal movement of said fastening bolt to longitudinally shorten and lengthen said ram mechanism.

10. In a press as defined in claim 1 in which selectively actionable control means is operably connected to said spacer member for reciprocally moving said spacer member in said selective displacement from and replacement into said assembly in said ram mechanism; and in which said moving means associated with said ram mechanism includes fluid cylinder means operably connected to said fastening bolt for longitudinally moving parts of said ram mechanism by longitudinal movement of said fastening bolt to longitudinally shorten and lengthen said ram mechanism.

11. In a press as defined in claim 1 in which said generally longitudinal fastening bolt is one of a multiplicity of similar fastening bolts similarly positioned in said ram mechanism and each having said longitudinal stretching means operably associated therewith; in which said selectively removable longitudinal spacer member is one of a multiplicity of selectively removable longitudinal spacer members in said ram mechanism each normally subject to said longitudinal tension of certain of said fastening bolts normally retained thereby under said compression, each of said spacer members being similarly selectively displaceable from and replaceable into said assembly in said ram mechanism; and in which said moving means associated with said ram mechanism is operably connected to each of said fastening bolts to longitudinally move said fastening bolts and thereby parts of said ram mechanism for longitudinally shortening and lengthening said ram mechanism during said displacement of said spacer members from said assembly in said ram mechanism.

12. In a press as defined in claim 1 in which said generally longitudinal fastening bolt is one of a multiplicity of similar fastening bolts similarly positioned in said ram mechanism and each having said longitudinal stretching means operable associated therewith; in which said selectively removable longitudinal spacer member is one of a multiplicity of selectively removable longitudinal spacer members in said ram mechanism each normally subject to said longitudinal tension of certain of said fastening bolts normally retained thereby under said compression, each of said spacer members being similarly selectively displaceable from and replaceable into said assembly in said ram mechanism; and in which said moving means associated with said ram mechanism includes fluid cylinder means operably connected to each of said fastening bolts for longitudinally moving said fastening bolts and thereby parts of said ram mechanism to longitudinally shorten and lengthen said ram mechanism during said displacement of said spacer members from said assembly in said ram mechanism.

13. In a press as defined in claim 1 in which said generally longitudinal fastening bolt is one of a multiplicity of similar fastening bolts similarly positioned in said ram mechanism and each having said longitudinal stretching means operably associated therewith; in which said selectively removable longitudinal spacer member is one of a multiplicity of selectively removable longitudinal spacer members in said ram mechanism each normally subject to said longitudinal tension of certain of said fastening bolts normally retained thereby under said compression, each of said spacer member being similarly selectively displaceable from and replaceable into said assembly in said ram mechanism; and in which each of said fastening bolt stretching means and said moving means associated with said ram mechanism include portions of selectively actionable double acting fluid cylinder means operably connected to each of said fastening bolts for longitudinally stretching said fastening bolts and for longitudinally moving said fastening bolts and through parts of said ram mechanism shortening and lengthening said ram mechanism during said displacement of said spacer members from said assembly in said ram mechanism.

14. In a press as defined in claim 1 in which said generally longitudinal fastening bolt is one of a multiplicity of similar fastening bolts similarly positioned in said ram mechanism and each having said longitudinal stretching means operably associated therewith; in which said selectively removable longitudinal spacer member is one of a multiplicity of selectively removable longitudinal spacer members in said ram mechanism each normally subject to said longitudinal tension of certain of said fastening bolts normally retained thereby under said compression, each of said spacer members being similarly selectively displaceable from and replaceable into said assembly in said ram mechanism; in which selectively actionable control means is operably connected to each of said spacer members for moving said spacer members generally transversely displaced from and replaced back into said assembly in said ram mechanism; and in which said moving means associated with said ram mechanism includes fluid cylinder means operably connected to each of said fastening bolts for longitudinally moving said fastening bolts and through parts of said ram mechanism longitudinally shortening and lengthening said ram mechanism during said displacement of said spacer members from said assembly in said ram mechanism.

15. In a press as defined in claim 1 in which said generally longitudinal fastening bolt is one of a multiplicity of similar fastening bolts similarly positioned in said ram mechanism and each having said longitudinal stretching means operably associated therewith; in which said selectively removable longitudinal spacer member is one of a multiplicity of selectively removable longitudinal spacer members in said ram mechanism each normally subject to said longitudinal tension of certain of said fastening bolts normally retained thereby under said compression, each of said spacer members being similarly selectively displaceable from and replaceable into said assembly in said ram mechanism; in which selectively actionable control means is operably connected to each of said spacer members for moving said spacer members generally transversely displaced from and replaced back into said assembly in said ram mechanism; and in which each of said fastening bolt stretching means and said moving means associated with said ram mechanism include portions of selectively actionable double acting fluid cylinder means operably connected to each of said fastening bolts for longitudinally stretching said fastening bolts and for longitudinally moving said fastening bolts to thereby move parts of said ram mechanism longitudinally shortening and lengthening said ram mechanism during said displacement of said spacer members from said assembly in said ram mechanism.

* * * * *